US011072190B2

(12) United States Patent
Manes et al.

(10) Patent No.: US 11,072,190 B2
(45) Date of Patent: Jul. 27, 2021

(54) PRINTER WITH ADJUSTABLE SLIDING PLANE

(71) Applicant: ALEPH S.R.L., Lurate Caccivio (IT)

(72) Inventors: Roberto Manes, Monza (IT); Alessandro Manes, Monza (IT); Giovanni Natalis, Pietra Ligure (IT)

(73) Assignee: Aleph S.R.L., Lurate Caccivio (IT)

( * ) Notice: Subject to any disclaimer, the term of this patent is extended or adjusted under 35 U.S.C. 154(b) by 0 days.

(21) Appl. No.: 16/642,190

(22) PCT Filed: Aug. 28, 2018

(86) PCT No.: PCT/IB2018/056542

§ 371 (c)(1),
(2) Date: Feb. 26, 2020

(87) PCT Pub. No.: WO2019/043566

PCT Pub. Date: Mar. 7, 2019

(65) Prior Publication Data

US 2020/0198372 A1 Jun. 25, 2020

(30) Foreign Application Priority Data

Aug. 29, 2017 (IT) ..... 102017000097133

(51) Int. Cl.
*B41J 11/00* (2006.01)
*B41J 3/407* (2006.01)

(52) U.S. Cl.
CPC ..... *B41J 11/007* (2013.01); *B41J 3/4078* (2013.01)

(58) Field of Classification Search
CPC ..... B41J 11/007; B41J 3/4078; B41J 15/048; B41J 11/005; B65H 2406/31; B65H 2601/122; B65H 5/224
See application file for complete search history.

(56) References Cited

U.S. PATENT DOCUMENTS

2004/0201168 A1* 10/2004 Greive ..... B65H 5/021 271/275
2006/0132573 A1 6/2006 Nishida
2013/0240593 A1 9/2013 Maeyama

FOREIGN PATENT DOCUMENTS

EP 0666180 A2 8/1995
WO 0222362 A2 3/2002
(Continued)

OTHER PUBLICATIONS

International Search Report dated Nov. 21, 2018 from counterpart PCT App No. PCT/IB2018/056542.

*Primary Examiner* — Bradley W Thies
(74) *Attorney, Agent, or Firm* — Shuttleworth & Ingersoll, PLC; Timothy Klima

(57) ABSTRACT

The invention relates to an ink-jet printer including: a support structure including two side walls; a transfer apparatus slidable for advancing the substrate in a direction x, the transfer apparatus comprising a conveyor belt and a stationary support plane; a print device including a print head operating along a direction y, perpendicular to the direction x; retaining means for maintaining the substrate adhering to the conveyor belt; and adjusting means of the transfer apparatus. The support plane includes two side ends which rest on the side walls. The adjusting means of the transfer apparatus include at least one side adjusting assembly positioned between a side wall and the respective side end of the support plane.

20 Claims, 9 Drawing Sheets

(56) References Cited

FOREIGN PATENT DOCUMENTS

| | | | |
|---|---|---|---|
| WO | 2015185085 | A1 | 12/2015 |
| WO | 2017060875 | A1 | 4/2017 |

* cited by examiner

PRINTER WITH ADJUSTABLE SLIDING PLANE

This application is the National Phase of International Application PCT/IB2018/056542 filed Aug. 28, 2018 which designated the U.S.

This application claims priority to Italian Patent Application No. 102017000097133 filed Aug. 29, 2017, which application is incorporated by reference herein.

The present invention relates to a large format printer having an adjustable sliding plane, in particular comprising an apparatus for adjusting flatness and orientation.

The use of industrial printers, typically ink-jet printers, for digital printing on large-format substrates, is known. The print substrates for these uses are usually made of paper, polymeric or textile material. By way of example, such printers are commonly used to print posters, billboards, banners, clothing textiles, furnishing fabrics, etc.

A printer of this type usually comprises a sliding transfer apparatus suitable for advancing the substrate in an advancement direction during printing.

Providing retaining means for maintaining the substrate adhering to the transfer apparatus is known as well. In a manner known per se, the retaining means can be based on the use of a layer of glue or electrostatic charges to maintain the substrate adhering to the transfer apparatus.

Another known solution for the retaining means, although not very common, is to provide a vacuum system. This system is suitable for keeping the substrate stationary with respect to the transfer apparatus during the advancement and printing phases.

FIG. 1 shows a large format industrial printer of the known type. In order to simplify the description, reference will be made to some conventions below. Since the printer is intended to be used in the presence of gravity acceleration g, it is intended that the latter uniquely defines the vertical direction. Likewise, it is understood that, based on gravity acceleration g, the terms "high", "higher", "above" and the like are defined unequivocally, with respect to the terms "low", "lower", "below" and the like. Furthermore, gravity acceleration g uniquely defines the horizontal planes, orthogonal to it.

The horizontal direction along which the advancement of the substrate occurs is called x, while the horizontal direction perpendicular to x is called y. The vertical direction forming a right-handed triplet with x and y is called z. According to these conventions, therefore, z and g have the same direction and g has a negative value.

With reference to substrate advancement, the terms "front", "forward", and the like, are defined with respect to the terms "back", "behind" and the like.

An important feature of the printer is the width of the printing area, where width means the size of the printing area in the direction y. Since the substrates are often arranged in roll form, the maximum length of the printing area (i.e. the dimension measured in the direction x) is almost indefinite and has limits that far exceed the most common requirements. On the contrary, the maximum width of the printing area is limited by the dimensions of the printer and in particular by the width of the transfer apparatus. For this reason, in general, the more a printer is wide the more it is appreciated on the market in terms of versatility.

However, as the skilled person can well understand, increasing the width of the printer leads to some problems. Among these, a rather important problem is that of guaranteeing the flatness and a correct orientation of the sliding transfer apparatus. In other words, it is necessary to ensure that the actual surface of the sliding transfer apparatus approximates in the best possible way a plane (flatness) and that this plane is parallel to the print plane xy defined strictly from the geometrical point of view by the two directions x and y (orientation). Usually the print plane xy that we try to approximate is a horizontal plane.

The sliding transfer apparatus usually comprises a conveyor belt mounted on two rollers, at least one of which is motorized. The two rollers have axes parallel to the direction y. In this way, the conveyor belt defines a transfer portion (upper) and a return portion (lower). In the transfer portion a printing area is defined at which, in a known manner, the effective deposition of the inks on the substrate takes place. In the return portion, service areas can be advantageously provided, for example for cleaning, washing and/or drying the conveyor belt.

The transfer portion and thus the printing area of the conveyor belt are supported by a stationary support plane, arranged below the belt itself. The support plane prevents the conveyor belt from assuming a concave configuration between the two rollers and gives it the stiffness necessary to guarantee a quality print.

As mentioned above, it is known to provide the transfer apparatus with a vacuum system. In this case the conveyor belt comprises a multitude of small through holes and, similarly, the stationary support plane comprises openings which communicate with the vacuum system. In this way, during operation of the printer, a substrate resting on the transfer apparatus is retained, dragged and held in position by the conveyor belt, thanks to the depression created by the vacuum system.

As already mentioned before, one of the conditions necessary for obtaining a high print quality is to guarantee the flatness and orientation of the transfer apparatus, in particular of the printing area. In fact, the final print quality depends, among other factors, also on the distance that separates the print head nozzles from the substrate. The flatness and the orientation of the transfer apparatus allow to keep this distance constant over the entire printing area, in order to have a homogeneous print quality. It is therefore necessary to guarantee the flatness and the orientation of the support plane which, in turn, determine the flatness and orientation of the printing area of the conveyor belt.

The flatness of the support plane is problematic for at least two factors. First of all, this plane must have a perforated structure, and therefore a relatively deformable one, in order to guarantee the functionality of the vacuum system. Moreover, as already mentioned above, there is a marked tendency to increase the width of the transfer apparatus.

Patent application WO 2017/060875, filed by the same Applicant, describes an ink-jet printer comprising a suction transfer apparatus, comprising means for adjusting only flatness. More specifically, in accordance with that solution, a vacuum box is provided below the conveyor belt. The box extends like a bridge between the side walls of the printer on which it is resting. The box is composed of a basin, closed at the top by an upper wall which constitutes the stationary support plane of the conveyor belt. Due to the width of the printer, the need arose to stiffen the box to limit its flexural deformation between the two side walls. For this reason, the vacuum box of WO 2017/060875 also includes a central septum that runs completely from one side to the other in the direction y to give it greater stiffness. Despite this, the deformation of the box due to bending is not at all negligible, which is why there are means for adjusting the flatness of the support surface inside the vacuum box. Conceptually, these means comprise a block formed by two wedge surfaces, one of which is fixed inside the vacuum box, while the other can slide in the direction y thanks to the action of a suitable guide screw. Sliding with respect to each other in the direction y, the two wedge surfaces determine a change in the overall height of the block in the direction z. By gradually increasing the height of the block, an intermediate thrust between the two side walls can be provided to the supporting plane so as to compensate for the deflection due to bending. However, the presence of the central septum prevents positioning of the flatness adjusting means in the optimal position, i.e. in the centre. For this reason, in the known solution it was necessary to double the means for adjusting flatness, providing two identical blocks, each having its own guide screw, at the two sides of the central septum.

In this way, WO 2017/060875 provides the possibility of cancelling the deflection due to bending, significantly improving the flatness of the support plane. This solution, although widely appreciated, showed some possibilities for improvement.

First of all, this solution assumes that the printer is perfectly mounted from the point of view of the orientation of the support plane. In other words, this solution assumes that, at the same time:

Each of the two abutments provided by the side walls, on which abutments the vacuum box rests, is perfectly horizontal (parallel to the direction x); and the two abutments provided by the side walls are perfectly aligned to each other in the direction z.

Only in this way the two abutments provided by the side walls define a perfectly horizontal plane. On the basis of this assumption, it is clear that the correct orientation of the support plane is assumed to be sure, and that its flatness can be significantly improved by cancelling the deflection due to bending of the vacuum box.

However, the reality of the facts is very different. First of all, in view of the size and overall mass of the printer, the installation according to the highest standard represents a considerable difficulty.

Furthermore, even in the case of an installation according to the highest standard, it is still possible for subsequent settlements to take place. Both the metallic carpentry of the printer and the civil works that hold it (foundation and paving) can undergo settlements such as to compromise the alignment of each of the abutments with respect to the direction x and/or the alignment of the two abutments with respect to each other. Naturally, in the absence of these alignments, the orientation of the support plane is lost, and therefore the cancellation of the deflection due to bending is useful but insufficient.

Moreover, the predisposition of double adjusting means naturally involves a doubling of the relative costs and, above all, of the masses. In this regard it has been noted that the vacuum box must frequently be subjected to maintenance cycles. For this reason, having to be removed and handled by an operator, the vacuum box must be as light as possible.

Furthermore, the provision of double adjusting means implies a greater complexity of the adjustment phase of flatness and orientation. In fact, both blocks must be adjusted and must be aligned to one another to avoid the introduction of an inclination of the support plane in the advancement direction x.

Furthermore, in the course of specific tests, the Applicant has noted that the efficiency of the known means for adjusting the flatness of the plane may be improved. In fact, in order to push on the lower surface of the support plane, such means necessarily generate an equal and opposite constraining reaction. In the specific case, this constraining reaction is provided by the bottom wall of the vacuum box. However, this bottom wall has a stiffness comparable to that of the upper wall. Therefore, the flatness adjustment action imposes a deformation on both walls on which the flatness adjusting means act. For this reason, the action of the flatness adjusting means is not particularly efficient.

Therefore, the object of the present invention is to overcome the drawbacks of the known art highlighted above.

Within this object, a task of the present invention is to make available a printer having a sliding transfer apparatus and equipped with means for adjusting the flatness and orientation which maintains the qualities already appreciated in known solutions and which at least partially improve the non-optimal aspects.

In particular, a task of the invention is that the means for adjusting the flatness and orientation of the sliding transfer apparatus allow to compensate for any misalignments of the supports provided by the side walls of the printer.

Furthermore, a task of the invention is that the means for adjusting the flatness and orientation of the sliding transfer apparatus are efficient and simple to use.

Finally, a task of the invention is to make available a sliding transfer apparatus equipped with means for adjusting the flatness and orientation which is easily removable for routine maintenance.

SUMMARY OF THE INVENTION

This object and these tasks are achieved by a printer according to the present disclosure.

The printer may further comprise one or more of the following preferred features.

Preferably, the printer also comprises retaining means adapted to keep the substrate adhering to the transfer apparatus.

The print direction y is preferably perpendicular to the advancement direction x.

The two directions x and y define the print plane xy. Preferably, the advancement direction x, the print direction y and the print plane xy are horizontal.

In some embodiments, the print head is movable along the print direction y, so as to substantially cover the whole width of the substrate. In other embodiments, the print head is fixed and has an extension such as to cover the entire width of the substrate.

Preferably, the transfer apparatus comprises a conveyor belt and a stationary support plane.

Preferably, the conveyor belt comprises a transfer portion having an outer surface designed to come into contact with the substrate. Preferably, the conveyor belt also comprises an inner surface intended to come into contact with the stationary support plane.

Preferably, the print device is arranged near the outer surface of the conveyor belt.

Preferably, the retaining means are adapted to maintain the substrate adherent and fixed with respect to the conveyor belt.

According to some embodiments, the support structure comprises two side walls.

Preferably, the stationary support plane comprises two side ends.

Preferably, the side ends of the stationary support plane rest on the side walls of the support structure.

According to some embodiments, the adjusting means of the transfer apparatus comprise at least one side adjusting assembly, positioned between a side wall and the respective side end of the stationary support plane.

Preferably the at least one side adjusting assembly is suitable for imposing to the respective side end of the stationary support plane a translation movement in the adjusting direction z, perpendicular to the print plane xy.

Preferably the at least one side adjusting assembly is suitable for imposing a rotation movement about the respective side end of the stationary support plane about the print direction y.

Preferably, the side adjusting assembly is suitable for imposing a translation in the adjusting direction z (e.g. vertical) which, in case of need, can be differentiated along the advancement direction x. The translation in the adjusting direction z can be differentiated between the front portion of the side end and the rear portion of the side end.

In accordance with some embodiments, the side adjusting assembly comprises a pair of screws: a pulling screw and a pushing screw, both having an axis parallel to the adjusting direction z. The pulling screw slides freely into a smooth through bore in the side end of the stationary support plane and is screwed into a threaded bore in the side wall of the support structure. The pushing screw is screwed into a threaded bore in the side end and is supported axially against a side wall surface. The combined tightening of both screws determines the blocking of the side end of the stationary support plane. By loosening one of the two screws and tightening the other, it is possible to move the side end along the adjusting direction z, thus adjusting the distance from the side wall.

In accordance with some embodiments, the side adjusting assembly comprises two sub-assemblies: a front side adjusting sub-assembly and a rear side adjusting sub-assembly. Preferably, each of the two side adjusting sub-assemblies comprises a pair of screws: a pulling screw and a pushing screw, both having an axis parallel to the adjusting direction z. Each pair of screws of each side adjusting sub-assembly operates as described above, allowing to adjust the position along the adjusting direction z of the respective portion of the side end.

Preferably, the side wall of the support structure defines an abutment, on which the side end of the stationary support plane is supported and restrained. The side adjusting assembly allows to impose a roto-translation to the abutment, in order to align it with the advancement direction x. Since the lateral end rests on the abutment, the roto-translation of the abutment is transmitted identical to the side end.

In accordance with other embodiments, the adjusting means of the transfer apparatus comprise two side adjusting assemblies: a first side adjusting assembly, already described above, and a second side adjusting assembly. The first side adjusting assembly is positioned between the first side wall and the first side end of the stationary support plane; the second side adjusting assembly is positioned between the second side wall and the second side end of the stationary support plane.

According to some embodiments, one of the two side adjusting assemblies is suitable for imposing a roto-translation of the respective lateral end, while the other of the two side adjusting assemblies is suitable for imposing a simple translation, in the accomplishment of which the relative side end remains parallel to itself.

In accordance with other embodiments, the structure of the second side adjusting assembly is substantially identical to that of the first side adjusting assembly; preferably the two structures are symmetrical with respect to the plane xz.

Preferably, also the second side adjusting assembly comprises two sub-assemblies: a front side adjusting sub-assembly and a rear side adjusting sub-assembly. Each of the two side adjusting sub-assemblies comprises preferably a pair of screws: a pulling screw and a pushing screw, both having an axis parallel to the adjusting direction z.

Preferably, the features, the operating modes and the adjustment potentials described above for the first side assembly and for its possible sub-assemblies apply equally to the second assembly and its possible sub-assemblies.

Preferably the adjusting means of the transfer apparatus comprise a specific adjusting sub-assembly for each angle of the stationary support plane.

Preferably, the support structure comprises a cross beam that extends between the two side walls.

Preferably the adjusting means of the transfer apparatus comprise a central adjusting assembly.

Preferably, the central adjusting assembly is positioned between the cross beam and the central portion of the stationary support plane.

Preferably the central adjusting assembly is suitable for imposing to the central portion of the stationary support plane a translation movement in the adjusting direction z, perpendicular to the print plane xy.

Preferably the first side adjusting assembly comprises:

- a surface, inclined with respect to the print plane xy and fixed to the first side end of the stationary support plane; and
- a movable wedge positioned between the inclined surface and the first side wall of the support structure.

The inclined surface forms with the print plane xy an angle which is preferably between 4° and 12°, even more preferably between 6° and 10°.

Preferably, the movable wedge has a complementary shape with respect to the inclined surface.

Preferably the travel of the movable wedge is obtained by at least one pair of screws: a pulling screw and a pushing screw, both having an axis parallel to the print direction y.

The pulling screw slides freely into a smooth through bore of the movable wedge and is screwed in a threaded bore of the side wall. The pushing screw is screwed into a threaded bore in the movable wedge and is supported axially on a surface of the side wall. The combined tightening of both screws determines the blocking of the movable wedge. Vice versa, by loosening one of the two screws and tightening the other, it is possible to move the movable wedge along the print direction y, thus adjusting its position with respect to the side wall.

In some embodiments, the movable wedge has an extension along the advancement direction x which allows to include both of said front side adjusting sub-assembly and said rear side adjusting sub-assembly.

Preferably each side adjusting sub-assembly comprises a pair of screws, each pair comprising a pulling screw and a pushing screw, both having an axis parallel to the print direction y.

The features, the operating modes and the adjustment potentials described above for the first side assembly and for its pair of screws apply equally to its two sub-assembly and to the respective pairs of screws.

In some embodiments, the upper surface of the movable wedge constitutes the abutment described above for resting the side end of the stationary support plane.

The structure of the second side adjusting assembly is substantially identical to that of the first side adjusting assembly, with the only difference that it is symmetrical with respect to the plane xz.

Preferably, the central adjusting assembly comprises:

a surface, inclined with respect to the print plane xy and fixed to the central portion of the stationary support plane; and a movable wedge positioned between the inclined surface and the cross beam of the support structure.

Preferably, the central adjusting assembly comprises just one adjusting screw allowing to translate the movable wedge in the print direction y, so that it remains always parallel to itself.

Preferably, the printer comprises retaining means adapted to keep the substrate adhering to the transfer apparatus.

According to an embodiment, the retaining means comprise a vacuum system.

Preferably, the vacuum system comprises a vacuum box

Preferably, the vacuum box comprises an openwork wall.

Preferably, the openwork wall constitutes the stationary support plane.

Preferably, the central adjusting assembly is placed outside the vacuum box, for example between the cross beam and a central portion of the vacuum box.

DESCRIPTION OF THE DRAWINGS

To better understand the invention and appreciate its advantages, some of its exemplifying and non-limiting embodiments are described below with reference to the accompanying drawings, wherein.

DETAILED DESCRIPTION OF THE INVENTION

Figure 1:
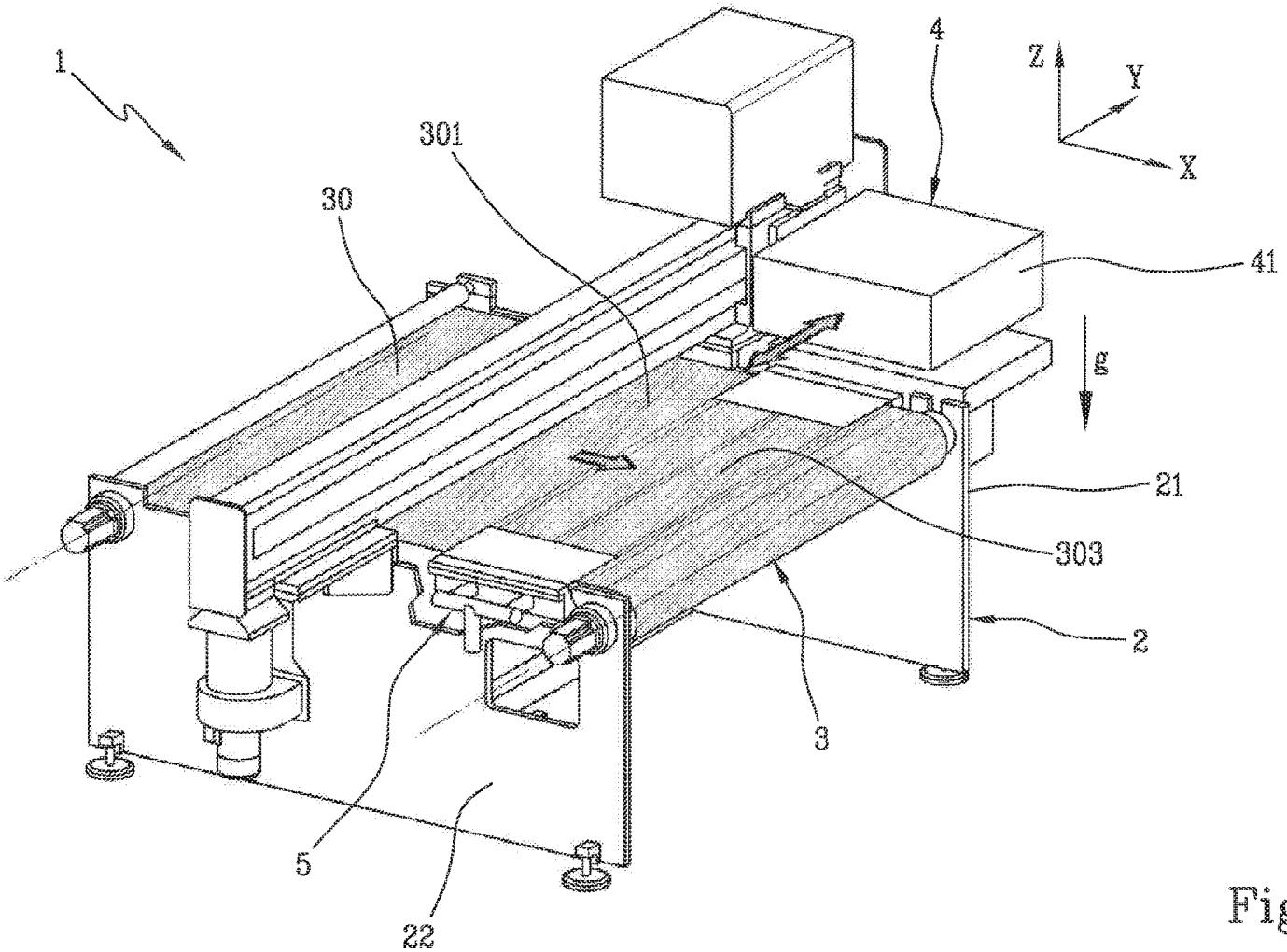
FIG. 1 shows a perspective view of an ink-jet printer with a vacuum sliding transfer apparatus according to the prior art.

The invention relates to a printer indicated as a whole with 1. For example, the printer 1 can be of an ink-jet type. Furthermore, the printer 1 can be of the type suitable for printing a substrate 9 made of textile, paper, polymeric or other material. The printer 1 includes:

a support structure 2;

a transfer apparatus 3 for advancing the substrate 9 in an advancement direction x;

a print device 4 comprising a print head 41 operating along a print direction y; and means 6 for adjusting the transfer apparatus 3.

Preferably, the printer 1 also comprises retaining means 5 adapted to maintain the substrate 9 adhering to the transfer apparatus 3.

Although not strictly necessary, the print direction y is preferably perpendicular to the advancement direction x. The two directions x and y define the print plane xy. Usually, the advancement direction x, the print direction y and the print plane xy are horizontal. This configuration, with the print device 4 placed above the transfer apparatus 3, although not the only possible configuration, allows certain advantages. For example, this configuration makes it possible to make the most of gravity acceleration g for the management of ink flows used in printing.

According to some embodiments, the print head 41 is movable along the print direction y, so as to substantially cover the whole width of the substrate 9 (i.e. the extension of the substrate 9 in the print direction y itself). In other embodiments, the print head 41 is fixed and has an extension in the print direction y such as to cover the entire width of the substrate 9 to be printed in any case.

Preferably, the transfer apparatus 3 comprises a conveyor belt 30 and a stationary support plane 31. The conveyor belt 30 advantageously comprises a transfer portion 301 having an outer surface 303 intended to come into contact with the substrate 9 and an inner surface intended to come into contact with the stationary support plane 31. Preferably, the print device 4 is arranged near the outer surface 303 of the conveyor belt 30.

Preferably, the retaining means 5 are adapted to maintain the substrate 9 adherent and fixed with respect to the conveyor belt 30.

In accordance with some embodiments of the invention, the support structure 2 comprises two side walls 21, 22 and the stationary support plane 31 comprises two side ends 311, 312. The side ends 311, 312 of the stationary support plane 31 preferably rest on the side walls 21, 22 of the support structure 2.

According to some embodiments, in the printer 1 according to the invention, the adjusting means 6 of the transfer apparatus 3 comprise at least one side adjusting assembly 61, positioned between a side wall 21 and the respective side end 311 of the stationary support plane 31.

Preferably the at least one side adjusting assembly 61 is suitable for imposing to the respective side end 311 of the stationary support plane 31 a translation movement in the adjusting direction z, perpendicular to the print plane xy, and/or a rotation movement about the print direction y.

The side adjusting assembly 61 is in fact suitable for imposing a translation in the adjusting direction z (usually vertical) which, in case of need, can be differentiated along the advancement direction x. In other words, translation in the adjusting direction z can be differentiated between the front portion $\mathbf{311}_1$ of the side end 311 and the rear portion $\mathbf{311}_2$ of the side end 311. As the skilled person can understand, a uniform translation in the adjusting direction z imposes a movement in which the side end 311 of the stationary support plane 31 remains parallel to itself. Conversely, a translation in the adjusting direction z differentiated along the advancement direction x imposes a movement in which the side end 311 also rotates about the print direction y.

The position along the adjusting direction z, since this is usually vertical, is also called 'height' in the following.

In accordance with some embodiments (not shown in the figures), the side adjusting assembly 61 comprises a pair of screws: a pulling screw and a pushing screw, both having an axis parallel to the adjusting direction z. The pulling screw slides freely into a preferably smooth through bore of the side end 311 and is screwed into a threaded bore of the side wall 21. The pushing screw is screwed into a threaded bore in the side end 311 and abuts with its head, i.e. abuts axially with one of its ends, on a side wall surface 21. The combined tightening of both screws determines the blocking of the side end 311. Vice versa, by loosening one of the two screws and tightening the other, it is possible to move the side end 311 along the adjusting direction z, thus adjusting the distance from the side wall 21. More particularly, starting from a blocking condition of the side end 311, in order to distance the latter from the side wall 21 along the adjusting direction z, the pulling screw must be loosened so as to create a free travel for the pushing screw. By tightening the pushing screw, the side end 311 is distanced from the side wall 21. Once the desired position has been obtained along the adjusting direction z, by tightening the pulling screw the block of the end 311 is again obtained. Vice versa, starting from the same locking condition, to bring the side end 311 close to the side wall 21 along the adjusting direction z it is necessary to loosen the pushing screw so as to create a free travel for the pulling screw. By tightening the pulling screw, the side end 311 is approached to the side wall 21. Once the desired position has been obtained along the adjusting direction z, by tightening the pushing screw the block of the end 311 is again obtained.

In accordance with some embodiments, the side adjusting assembly 61 preferably comprises two sub-assemblies spaced from each other along the advancement direction x: a front side adjusting sub-assembly 611 and a rear side adjusting sub-assembly 612. Each of the two side adjusting sub-assemblies 611 and 612 comprises preferably a pair of screws: a pulling screw and a pushing screw, both having an axis parallel to the adjusting direction z. Each pair of screws of each side adjusting sub-assembly operates as described above, allowing to adjust the position along the adjusting direction z of the respective portion of the side end 311. In particular, the pair of screws of the front side adjusting sub-assembly 611 allows to adjust the position along the adjusting direction z of the front portion $\mathbf{311}_1$ of the side end 311; similarly, the pair of screws of the rear side adjusting sub-assembly 612 allows to adjust the position along the adjusting direction z of the rear portion of the side end 311. As already stated above, an identical regulation of the two side adjusting sub-assemblies 611 and 612 determines a translation in which the side end 311 remains parallel to itself. Vice versa, by means of adjustment interventions having respectively different entities on the two side adjusting sub-assemblies 611 and 612, it is also possible to determine a rotation of the side end 311 around the print direction y.

To explain in more detail the functionality of the side adjusting assembly 61, reference will be made hereinafter to FIGS. 8*a* and 8*b*. FIG. 8*a* shows schematically a printer 1 installed on a base which is not perfectly horizontal; for this reason, the stationary support plane 31 of the printer 1 is misaligned with respect to the horizontal one (indicated by the dashed and dotted line). In FIG. 8*a* the misalignment with respect to the horizontal is exaggerated in order to be easily perceived by the reader. Usually the misalignments that occur in reality are much smaller.

Figure 8B:
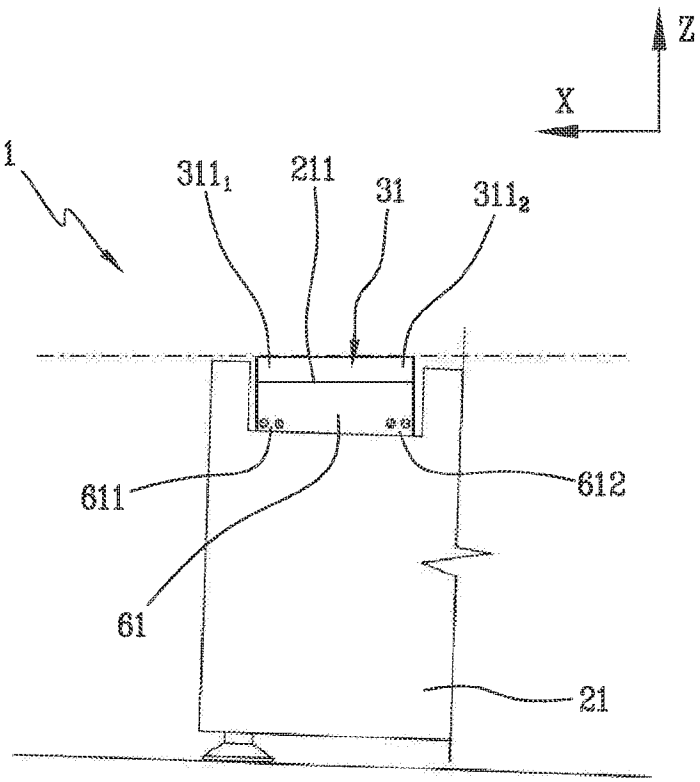
FIG. 8*b* shows a schematic side view of a printer according to the invention in a working configuration.
Figure 8A:
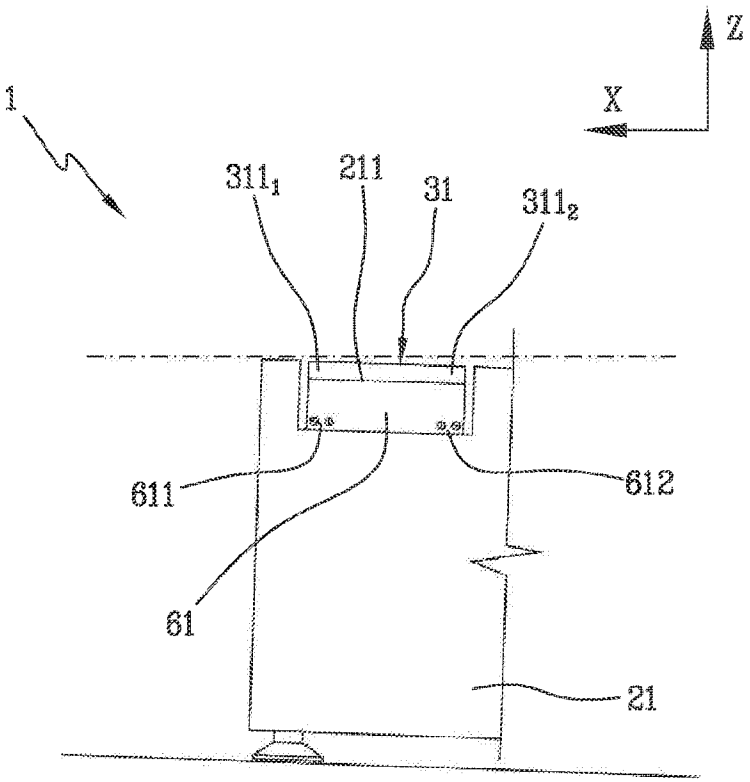
FIG. 8*a* shows a schematic side view of a printer according to the invention in an assembly configuration.

By operating in a differential manner on the side adjusting assembly 61 it is possible to raise the side end 311 to a different extent along the advancement direction x, so as to bring it to the configuration of FIG. 8*b* in which it is perfectly aligned with the horizontal.

Preferably, the side wall 21 defines an abutment 211, on which the side end 311 of the stationary support plane 31 is supported and restrained. In this case, the side adjusting assembly 61 allows to impose a roto-translation to the abutment 211, in order to align it with the advancement direction x. Since the lateral end 311 rests on the abutment 211, the roto-translation of the abutment 211 is transmitted identical to the side end 311.

This solution, in which the side adjusting assembly 61 imposes a roto-translation to the abutment 211, allows to obtain some advantages. In this case, in fact, the possible removal of the support plane 31, for example for maintenance, does not affect the adjustment of the abutment 211 which remains perfectly aligned with the advancement direction x. When the support plane 31 is re-assembled, its side end 311 again assumes the correct position thanks to the abutment 211. This particular configuration makes it easier to perform the maintenance of the printer 1 and of the support plane 31 in particular.

In accordance with other embodiments, in the printer 1 according to the invention, the adjusting means 6 of the transfer apparatus 3 comprise two side adjusting assemblies: a first side adjusting assembly 61, already described above, and a second side adjusting assembly 62. The first side adjusting assembly 61 is positioned between the first side wall 21 and the first side end 311 of the stationary support plane 31; the second side adjusting assembly 62 is positioned between the second side wall 22 and the second side end 312 of the stationary support plane 31.

According to some embodiments, one of the two side adjusting assemblies (for example the first side adjusting assembly 61) is suitable for imposing a roto-translation of the respective side end (in the same example the first side end 311), while another of the two side adjusting assemblies (in the example the second side adjusting assembly 62) is suitable for imposing a straight simple translation, in which the relative side end (in the example the second side adjusting end 312) remains parallel to itself.

In accordance with other embodiments, the structure of the second side adjusting assembly 62 is substantially identical to that of the first side adjusting assembly 61; with the only difference that it is symmetrical with respect to the plane xz.

Preferably, also the second side adjusting assembly 62 comprises two sub-assemblies: a front side adjusting sub-assembly 621 and a rear side adjusting sub-assembly 622. Each of the two side adjusting sub-assemblies 621 and 622 comprises preferably a pair of screws: a pulling screw and a pushing screw, both having an axis parallel to the adjusting direction z.

Obviously, the features, the operating modes and the adjustment potentials described above for the first side assembly 61 and for its possible sub-assemblies 611 and 612 apply equally also to the second assembly 62 and its possible sub-assemblies 621 and 622. In this way, each of the two side adjusting assemblies 61 and 62 allows to align perfectly to the advancement direction x the respective side ends 311 and 312 of the stationary support plane 31.

In some circumstances, a perfectly horizontal orientation of the two side ends 311 and 312 may prove insufficient to determine the alignment of the stationary support plane 31 to the print plane xy. If, for example, the two side ends 311 and 312, although both perfectly horizontal, were placed at different heights along the adjusting direction z, then the stationary support plane 31 as a whole would be inclined with respect to the print plane xy. The presence of two side adjusting assemblies 61 and 62 makes it possible to easily adjust the two heights z at which the two side ends 311 and 312 are located with respect to each other. In particular, the adjustment must lead to no difference between the two heights z with respect to a horizontal plane.

In the embodiments described above, the adjusting means 6 of the transfer apparatus 3 comprise a specific adjusting sub-assembly for each portion of the side ends of the stationary support plane 31. In particular: the first front side adjusting sub-assembly 611 is associated with the front portion $\mathbf{311}_1$ of the first side end 311; the first rear side adjusting sub-assembly 612 is associated with the rear portion $\mathbf{311}_2$ of the first side end 311; the second front side adjusting sub-assembly 621 is associated with the front portion $\mathbf{312}_1$ of the second side end 312; the second rear side adjusting sub-assembly 622 is associated with the rear portion $\mathbf{312}_2$ of the second side end 312.

The skilled person can easily understand the advantages deriving from the possibility of fine and independent adjustment of the position of each portion of the side ends of the stationary support plane 31. This configuration allows in fact a high versatility of the adjustment.

When the two side ends 311 and 312 of the stationary bearing surface 31 are perfectly horizontal, and when they are exactly at the same height in the adjusting direction z, the best conditions are put in place to ensure perfect orientation of the stationary support plane 31 with respect to the print plane xy, typically horizontal.

However, as already explained above with reference to the prior art, in some cases the conditions provided by the two side adjusting assemblies 61 and 62 may not be sufficient to guarantee the flatness of the stationary support plane 31.

Since the stationary support plane 31 is preferably arranged as a bridge between the two side walls 21 and 22, it is subject to gravity which, in some cases, can cause a not negligible deformation of the plane due to bending. In particular, it may happen that the central portion 310 of the stationary support plane 31 falls by a certain height in the adjusting direction z (called "deflection") with respect to the side ends 311 and 312.

Figure 9B:
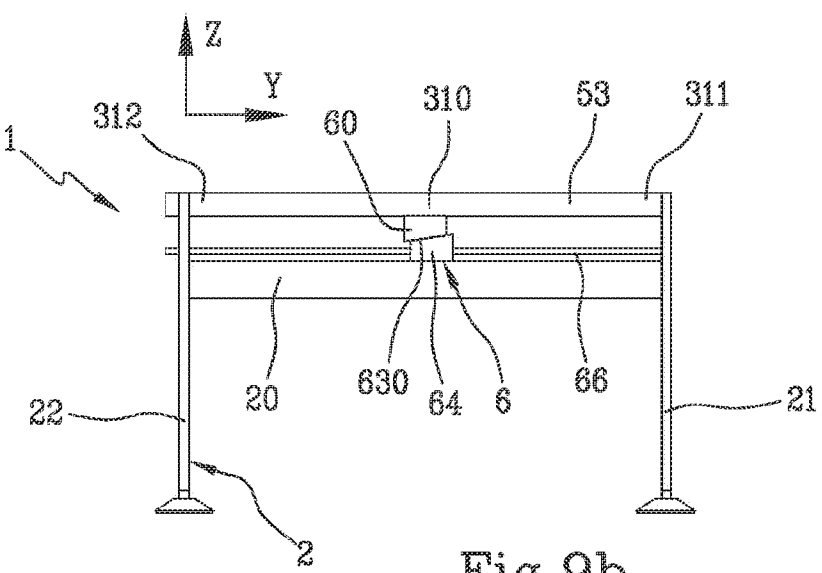
FIG. 9*b* shows a schematic front view of a printer according to the invention in a working configuration.
Figure 9A:
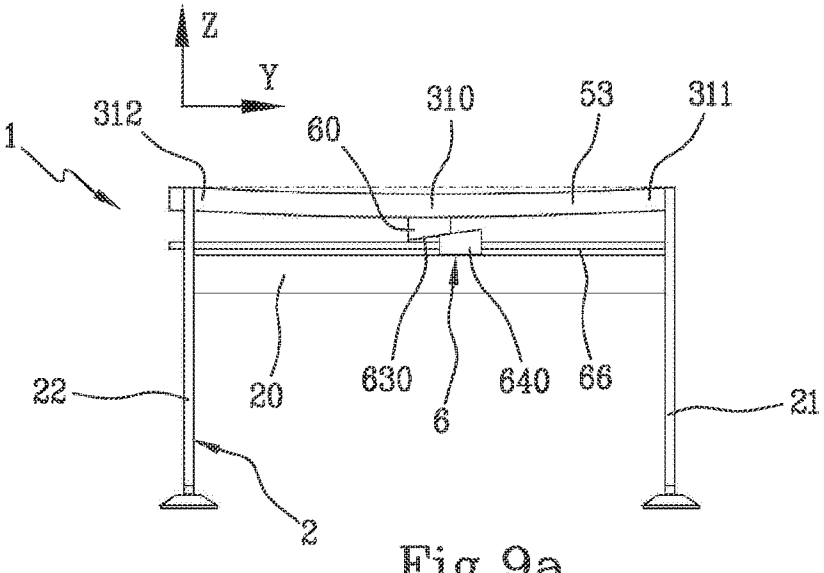
FIG. 9*a* shows a schematic front view of a printer according to the invention in an assembly configuration.

To explain this specific problem in more detail, reference will be made hereinafter to FIGS. 9*a* and 9*b*. FIG. 9*a* schematically shows a printer 1 whose stationary support plane 31, although it has the perfectly horizontal side ends 311 and 312 of exactly the same height z, is subject to a not negligible deformation with respect to the horizontal plane (represented by the dashed and dotted line). In FIG. 9*a* the deflection with respect to the horizontal is exaggerated in order to be easily perceived by the reader. Usually the deflections that occur in reality are much smaller.

Preferably, the support structure 2 comprises a cross beam 20 that extends between the two side walls 21 and 22. The adjusting means 6 of the transfer apparatus 3 advantageously comprise a central adjusting assembly 60 positioned between the cross beam 20 and the central portion 310 of the stationary support plane 31.

Preferably the central adjusting assembly 60 is suitable for imposing to the central portion 310 of the stationary support plane 31 a translation movement in the adjusting direction z, perpendicular to the print plane xy. In this way, the action of the central adjusting assembly 60 allows to cancel the deflection and to bring the central portion 310 back to the same identical height of the two side ends 311 and 312. This configuration is illustrated schematically in FIG. 9*b* in which the perfect flatness of the stationary support plane 31 is restored.

A particular embodiment is described below for the adjusting means 6 of the transfer apparatus 3. Although this form is not the only one possible, it has proved to be particularly advantageous.

Figure 5:
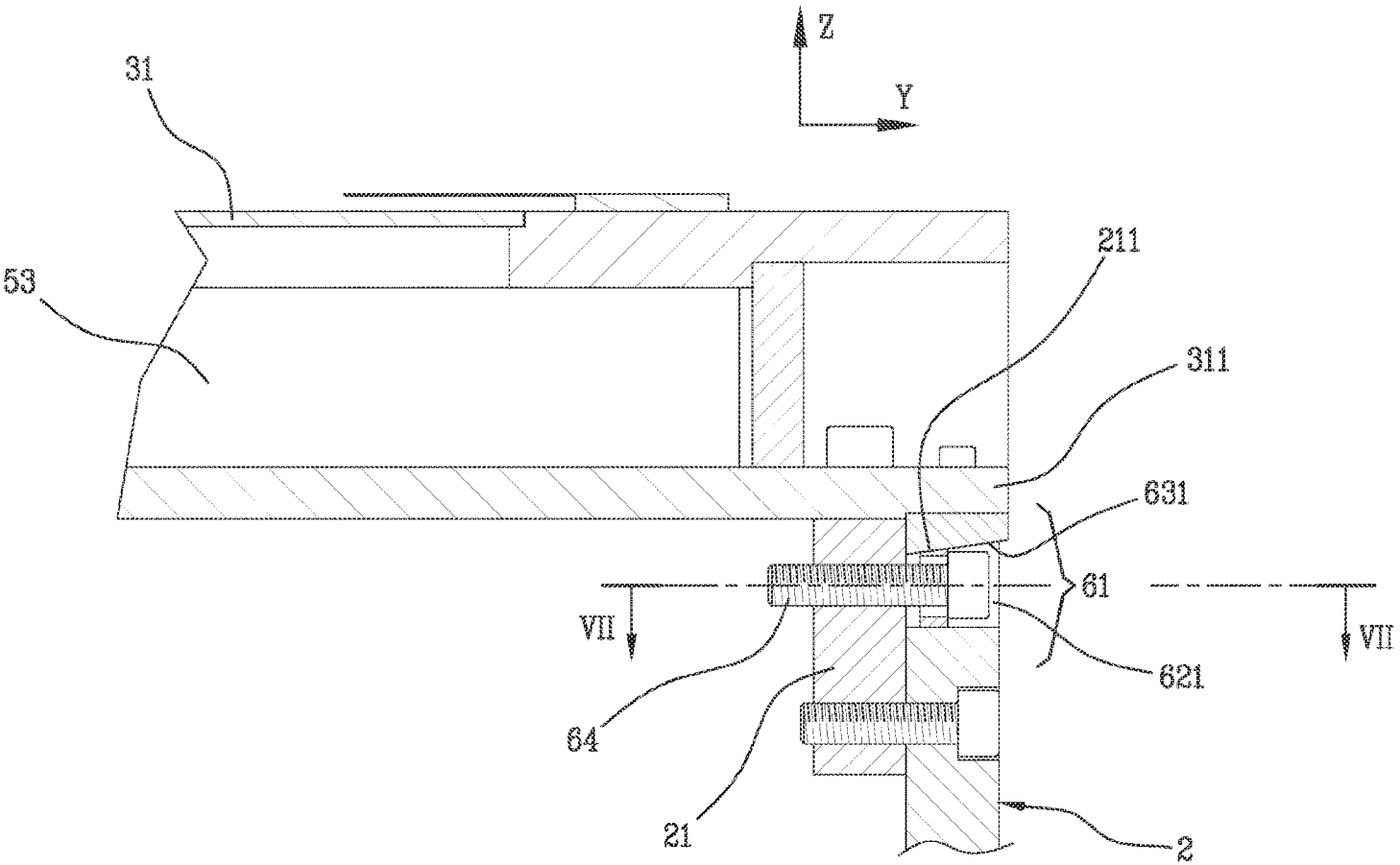
FIG. 5 shows an enlarged view of the detail indicated with V in FIG. 4, where for greater clarity some elements not directly connected to the invention have been removed.
Figure 6:
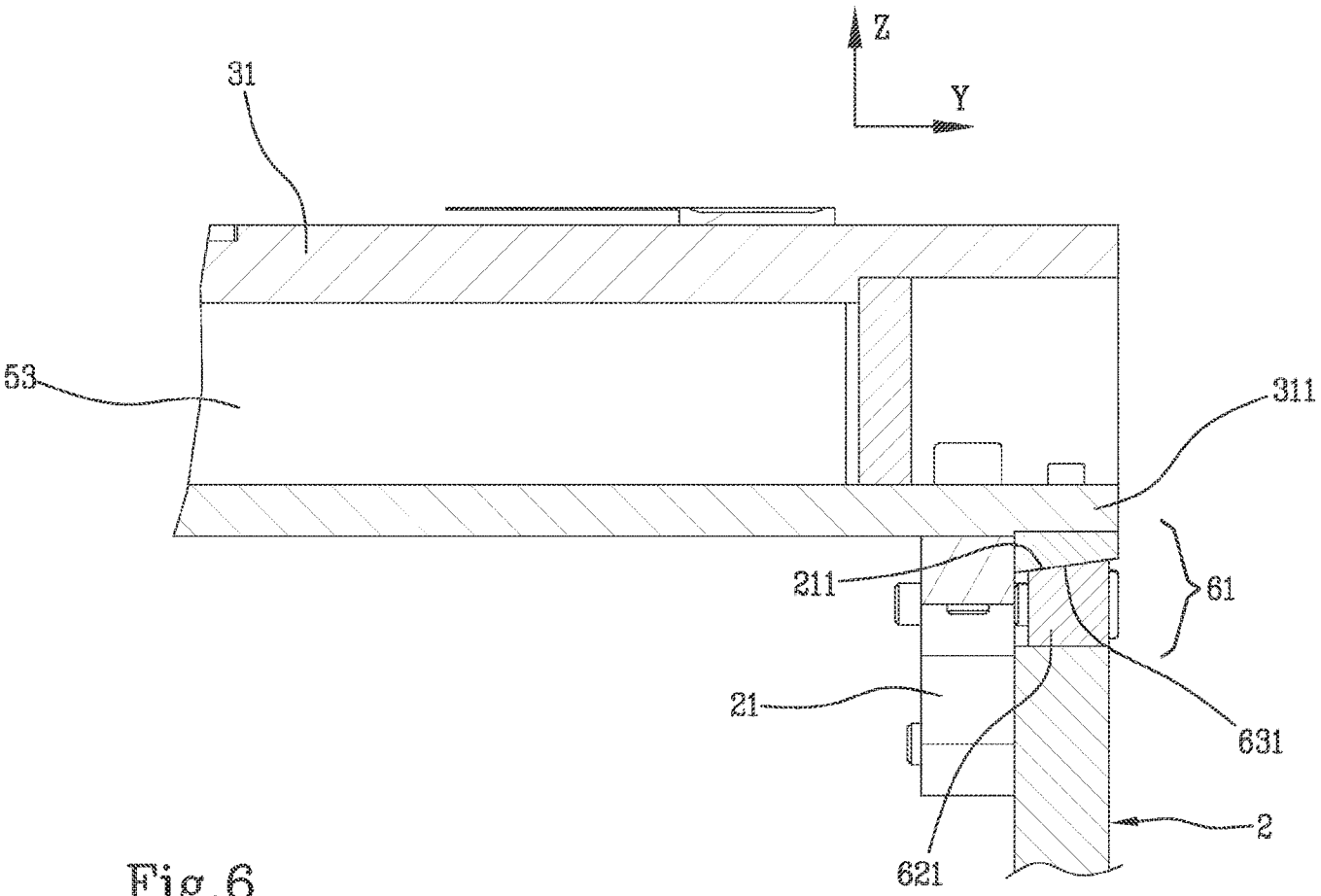
FIG. 6 shows a cross section made along line VI-VI of FIG. 7.

This embodiment is described in detail for the first side adjusting assembly 61; however, the same description, *mutatis mutandis*, applies to the second side adjusting assembly 62 and to the central adjusting assembly 60. See FIGS. 5 to 7 in particular.

The first side adjusting assembly 61 preferably comprises:

- a surface 631, inclined with respect to the print plane xy and fixed to the first side end 311 of the stationary support plane 31; and
- a movable wedge 641 positioned between the inclined surface 631 and the first side wall 21 of the support structure 2.

The inclined surface 631 forms with the print plane xy an angle which is preferably between 4° and 12°, even more preferably between 6° and 10°. The movable wedge 641 has a complementary shape with respect to the inclined surface 631 (see in particular the section of FIG. 6). Smaller angles allow finer adjustments but require longer travels for the movable wedge 641. In contrast, wider angles allow shorter strokes for the movable wedge 641 but involve more abrupt adjustments.

The travel (in the print direction y) of the movable wedge 641 is obtained by at least one pair of screws: a pulling screw 64 and a pushing screw 65, both having an axis parallel to the print direction y. The pulling screw 64 slides freely into a smooth through bore of the movable wedge 641 and is screwed in a threaded bore of the side wall 21. The pushing screw 65 is screwed into a threaded bore in the movable wedge 641 and abuts with its head, i.e. abuts axially with one of its ends, on a side wall surface 21. The combined tightening of both screws determines the blocking of the movable wedge 641. Vice versa, by loosening one of the two screws and tightening the other, it is possible to move the movable wedge 641 along the print direction y, thus adjusting its position with respect to the side wall 21. More particularly, starting from a blocking condition of the movable wedge 641, in order to distance the latter from the side wall 21 along the print direction y, the pulling screw 64 must be loosened so as to create a free travel for the pushing screw 65. Tightening the pushing screw 65 moves the movable wedge 641 away from the side wall 21. Once the desired position has been obtained along the print direction y, by tightening the pulling screw 64, the block of the movable wedge 641 is again obtained. Conversely, starting from the same locking condition, in order to move the movable wedge 641 closer to the side wall 21 along the print direction y, it is necessary to release the pushing screw 65 so as to create a free travel for the pulling screw 64. By tightening the pulling screw 64, the movable wedge 641 is approached to the side wall 21. Once the desired position has been obtained along the print direction y, by tightening the pushing screw 65, the block of the movable wedge 641 is again obtained. The combined tightening of both screws determines the blocking of the movable wedge 641. Vice versa, by loosening one of the two screws and tightening the other, it is possible to move the movable wedge 641 along the print direction y. The translation of the movable wedge 641 along the print direction y involves a translation of the inclined surface 631 in the adjusting direction z. This translation allows to adjust the height of the first side end 311 of the stationary support plane 31.

Figure 7:
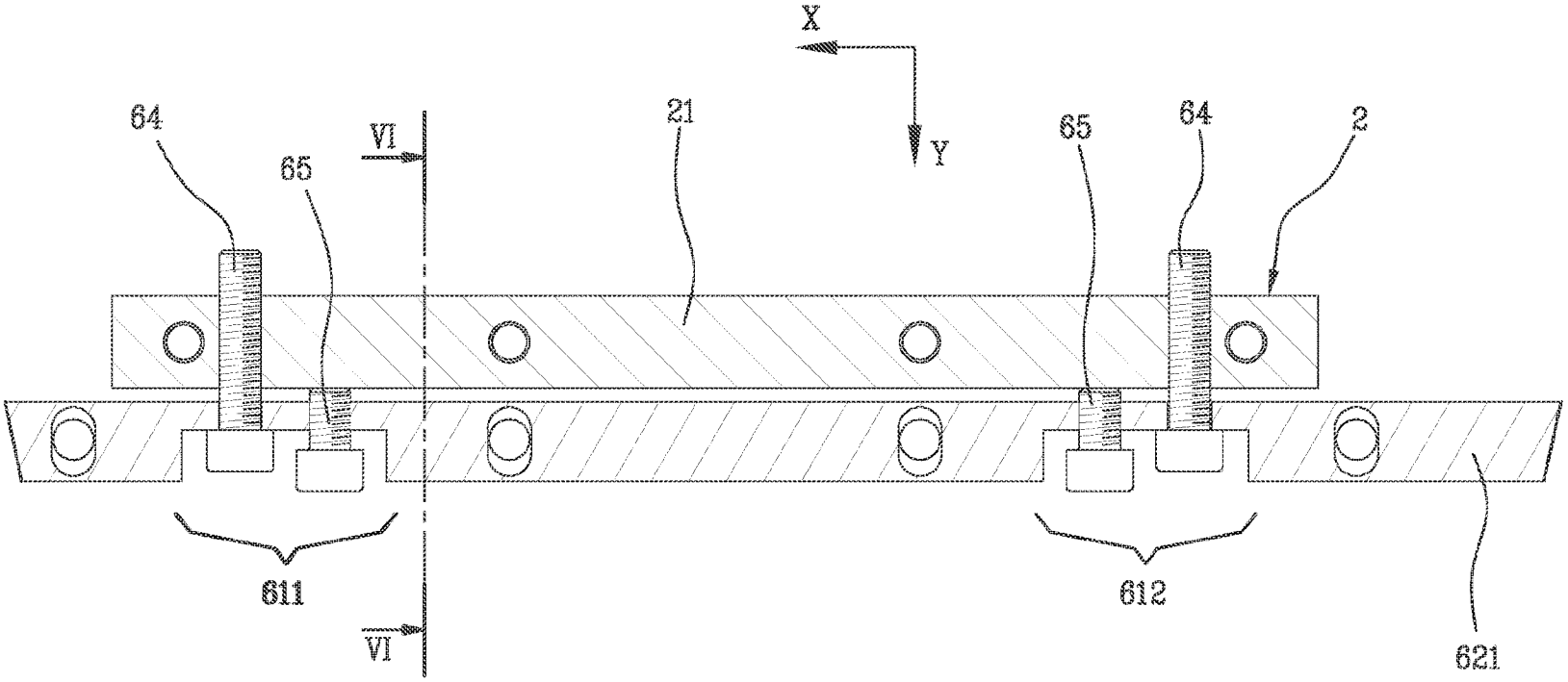
FIG. 7 shows a cross section made along line VII-VII of FIG. 5.

As can be seen in particular in FIG. 7, the second side adjusting assembly 61 comprises two sub-assemblies: the front side adjusting sub-assembly 611 and the rear side adjusting sub-assembly 612. The movable wedge 641 and, consequently, the inclined surface 631 conjugated to it, have an extension along the advancement direction x which allows to accommodate both sub-assemblies. Moreover, each side adjusting sub-assembly comprises a pair of screws, each pair comprising a pulling screw 64 and a pushing screw 65, both having an axis parallel to the print direction y.

Obviously, the features, the operating modes and the adjustment potentials described above for the first side assembly 61 and for its pair of screws apply equally to its two sub-assemblies 611 and 612 and to the respective pairs of screws.

In this way, it is possible to impose different travels with the two sub-assemblies 611 and 612 and with the respective pairs of screws. This imposes to the movable wedge 641 a translation in the print direction y differentiated along the advancement direction x. This differentiated translation of the movable wedge 641 imposes to the inclined surface 631 a translation in the adjusting direction z differentiated along the advancement direction x. Thus, a movement is obtained in which the inclined surface 631 also makes a rotation about the print direction y.

In this particular embodiment, the upper surface of the movable wedge 641 constitutes the abutment 211 described above.

The structure of the second side adjusting assembly 62 is substantially identical to that of the first side adjusting assembly 61, with the only difference that it is symmetrical with respect to the plane xz.

The central adjusting assembly 60 usually has a simpler structure. It preferably includes:

- a surface 630, inclined with respect to the print plane xy and fixed to the central portion 310 of the stationary support plane 31; and
- a movable wedge 640 positioned between the inclined surface 630 and the cross beam 20 of the support structure 2.

For what is not specifically described below, the central adjusting assembly 60 is preferably analogous to the first side adjusting assembly 61 described above. For instance, the surface 630 forms with the print plane xy an angle which is preferably between 4° and 12°, even more preferably between 6° and 10°. The movable wedge 640 preferably has a complementary shape with respect to the inclined surface 630.

Advantageously, the central adjusting assembly 60 comprises just one adjusting screw 66 allowing to translate the movable wedge 640 in the print direction y, so that it remains always parallel to itself. The translation of the movable wedge 640 along the print direction y involves a translation of the inclined surface 630 in the adjusting direction z. This translation allows to adjust the height of the central portion 310 of the stationary support plane 31, for example to cancel the deflection due to bending and restore flatness.

As already reported briefly above, the printer 1 preferably comprises retaining means 5 adapted to maintain the substrate 9 adhering to the transfer apparatus 3. In particular, in the case in which the latter comprises a conveyor belt 30, the retaining means 5 are adapted to keep the substrate 9 adherent and stationary with respect to the conveyor belt 30.

It is possible to provide different embodiments of the retaining means 5. For example, they may include an apparatus for applying a layer of glue to the transfer apparatus 3 and/or to the substrate 9 in a controlled manner. In this case, it is preferable to provide an apparatus for removing any glue residues from the substrate 9 once the printing is finished.

According to another embodiment, the retaining means 5 can comprise a system suitable for generating two different electrostatic charges between the transfer apparatus 3 and the substrate 9. In this case the electrostatic attraction makes it possible to maintain the substrate 9 adhering to the transfer apparatus 3.

According to the embodiment of the invention illustrated in the attached figures, the retaining means 5 comprise a vacuum system 50. The vacuum system 50 comprises a vacuum box 53 which in turn comprises an openwork wall 531 which constitutes the stationary support plane 31.

Preferably, the central adjusting assembly 60 is placed outside the vacuum box 53, between the cross beam 20 and a central portion 530 of the vacuum box 53.

In this way, the arrangement and the configuration of the central adjusting assembly 60 are not affected by the internal structure of the vacuum box 53. In particular, the presence of any septa, which completely cross the vacuum box 53 in the print direction y, does not in any way affect the arrangement and the configuration of the central adjusting assembly 60. Moreover, thanks to this solution, the action of the central adjusting assembly 60 is particularly efficient. In fact, the constraining reaction which develops following the thrust effected by the central adjusting assembly 60 on the central portion 530 of the vacuum box 53, is directly opposed by the cross beam 20.

Figure 9C:
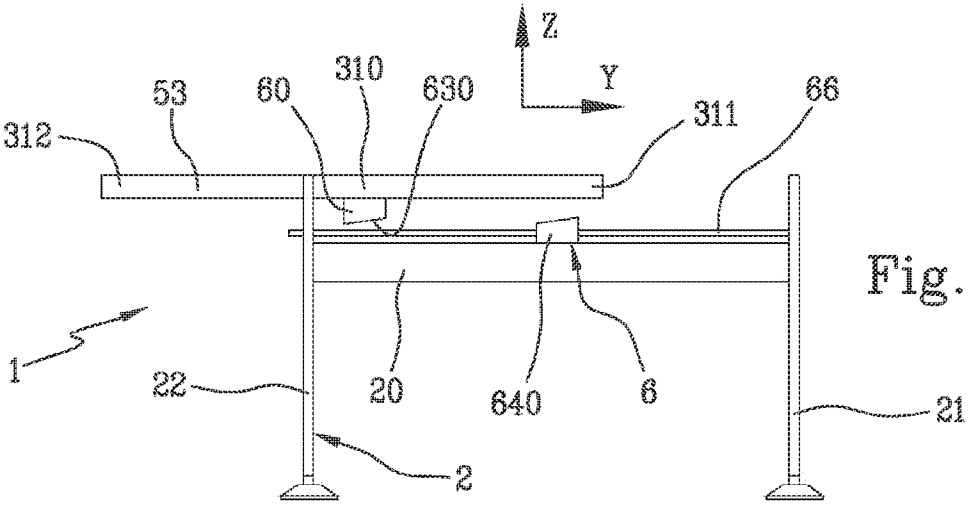
FIG. 9*c* shows a schematic front view of a printer according to the invention in a maintenance configuration.

Finally, when the vacuum box 53 has to be disassembled and removed for maintenance, together with the vacuum box 53 only the inclined surface 630 is removed, while the remaining parts of the central adjusting assembly 60 (in particular the adjusting screw 66 and the movable wedge 640) remain on the printer 1. In this regard, see in particular the diagram of FIG. 9*c*. This particular configuration makes it easier to perform the maintenance of the printer 1 and of the vacuum box 530 in particular.

Figure 2:
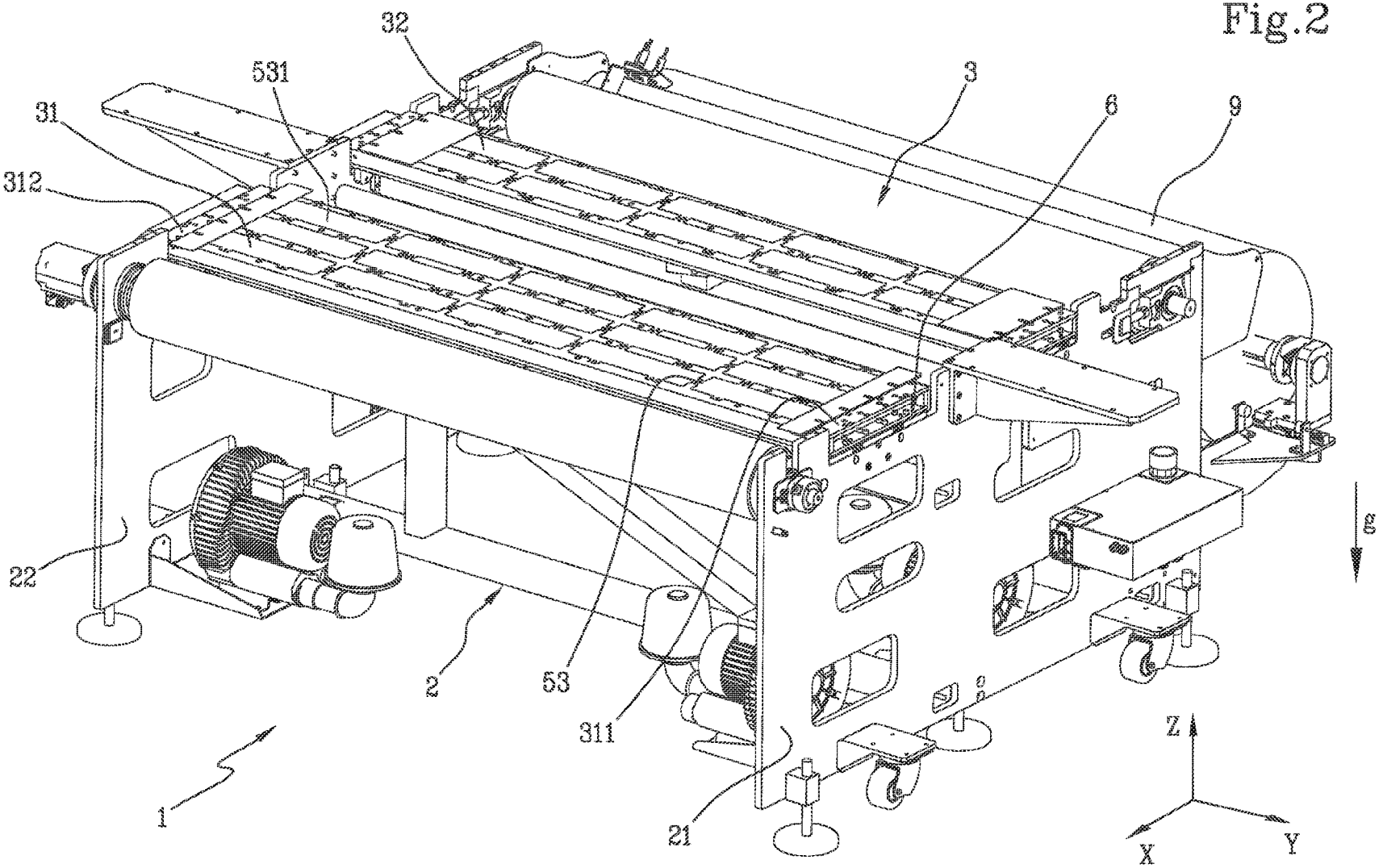
FIG. 2 shows a perspective view of an ink-jet printer with a vacuum sliding transfer apparatus according to the invention, where for greater clarity the printing members and the conveyor belt have been removed.
Figure 3:
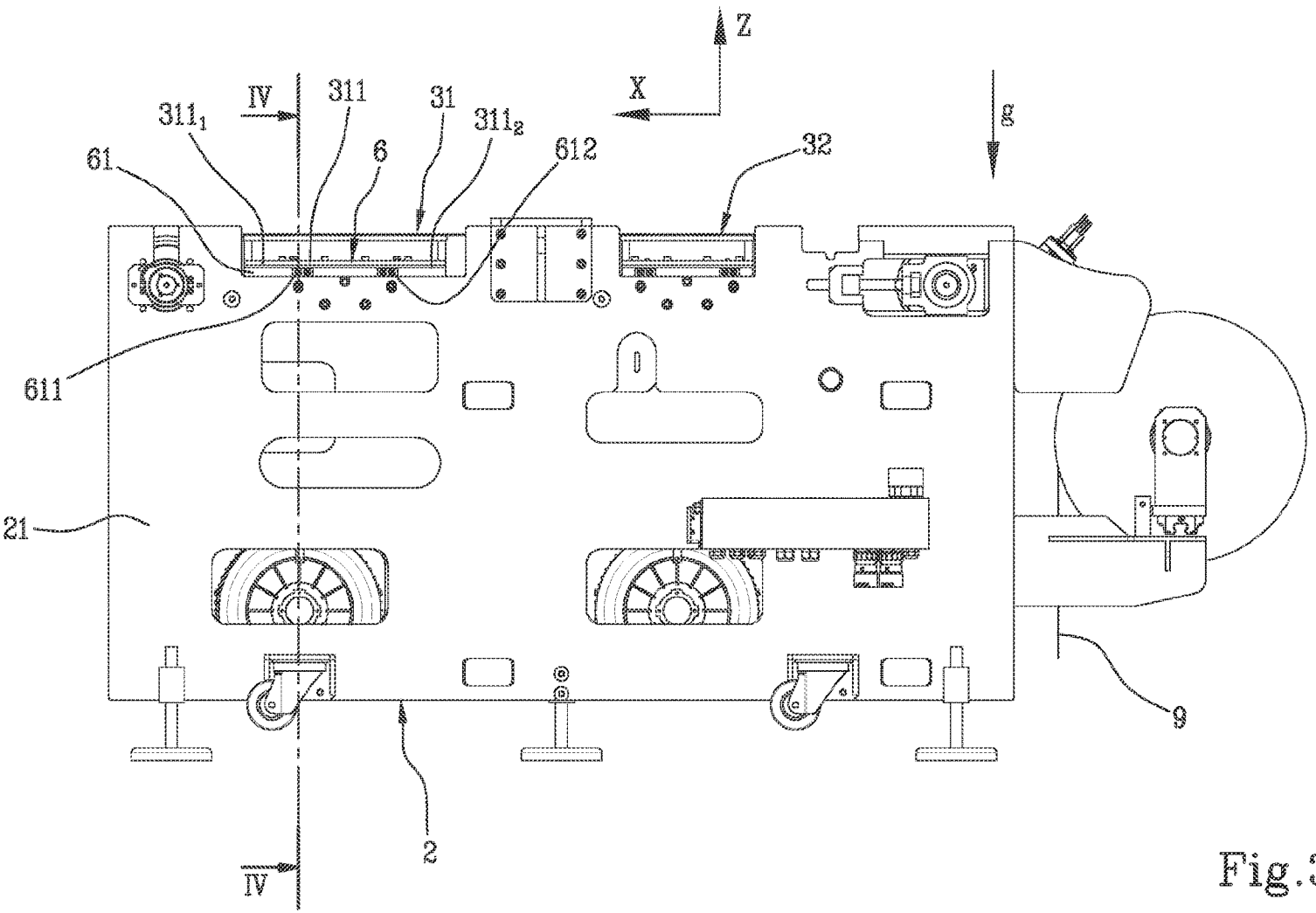
FIG. 3 shows a side view of the printer of FIG. 2.
Figure 4:
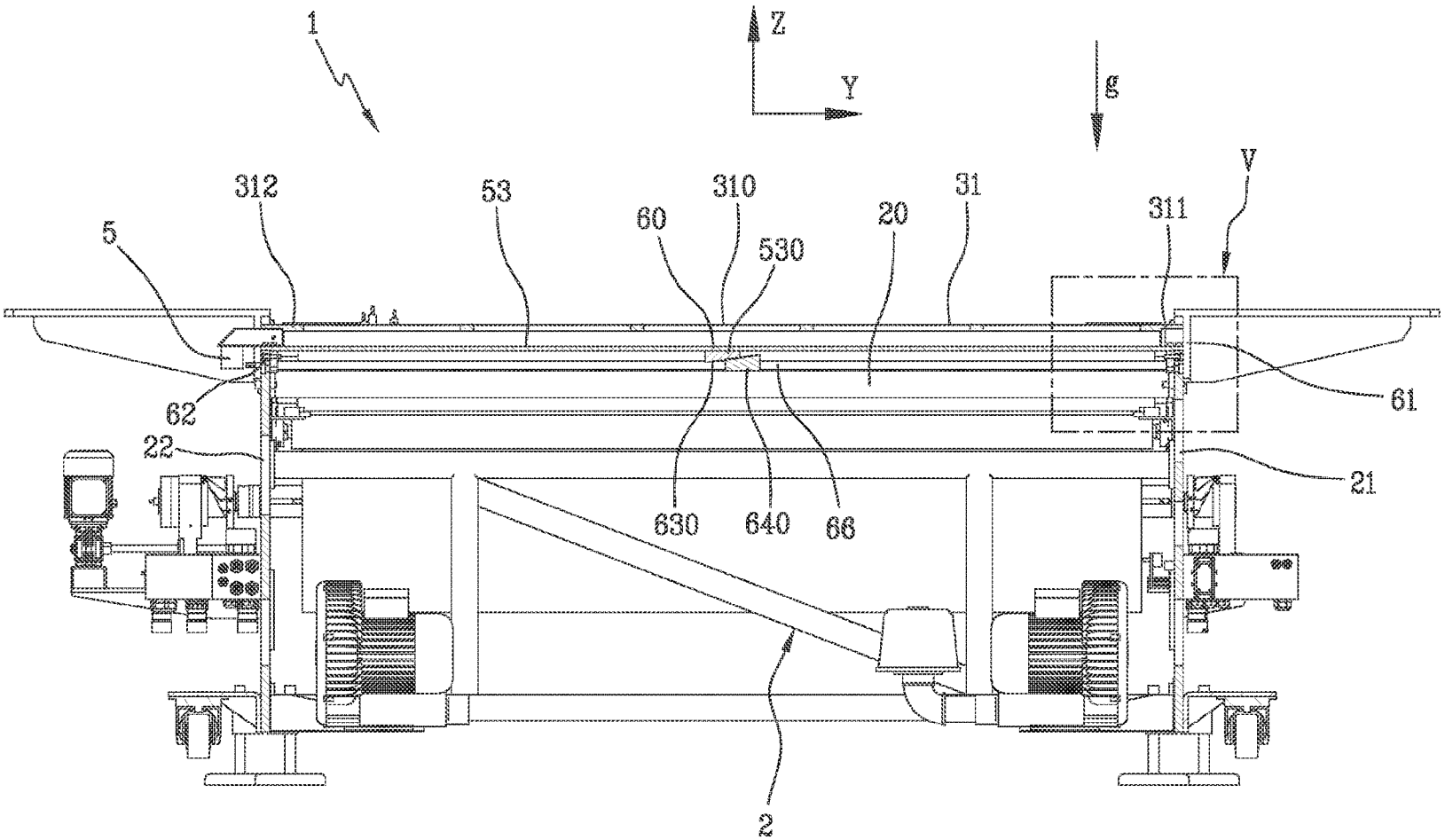
FIG. 4 is a cross section made along line IV-IV of FIG. 3.

In some embodiments of the printer 1 according to the invention, the transfer apparatus 3 comprises a conveyor belt 30 and two stationary support planes: a first stationary support plane 31 and a second stationary support plane 32. The first stationary support plane 31, already described above, is preferably placed at the print head 41. The second stationary support plane 32 may comprise one or more of the technical features described above for the first stationary support plane 31. In particular, the adjusting means 6 of the transfer apparatus 3 comprise one or more adjusting assemblies adapted to guarantee the flatness and/or the correct orientation of the second stationary support plane 32 with respect to the print plane xy. With respect to the first stationary support plane 31, the second stationary support plane 32 is preferably placed in a rearmost position along the advancement direction x; in this regard, see in particular FIGS. 2 and 3.

As the skilled person can well understand, the invention achieves the object of overcoming the drawbacks highlighted above with reference to the prior art.

Within this object, the invention makes available a printer having a sliding transfer apparatus and equipped with means for adjusting the flatness and orientation which maintains the qualities already appreciated in known solutions and which improves their non-optimal aspects.

In particular, the invention makes available means for adjusting the flatness and orientation of the sliding transfer apparatus which allow to compensate for any misalignments of the supports provided by the side walls of the printer.

Moreover, according to the invention, the means for adjusting the flatness and orientation of the sliding transfer apparatus are efficient and simple to use.

Finally, according to the invention, the sliding transfer apparatus equipped with means for adjusting the flatness and orientation is easily removable for routine maintenance.

It is clear that the specific features are described in relation to various embodiments of the invention with exemplifying and non-limiting intent. Obviously, a person skilled in the art may make further modifications and variations to this invention, in order to meet contingent and specific requirements. For example, the technical features described in connection with an embodiment of the invention may be extrapolated from it and applied to other embodiments of the invention. Such modifications and variations are, however, contained within the scope of the invention, as defined by the following claims.

The invention claimed is:

1. An ink-jet printer for printing a substrate in textile, paper, polymeric or other material, the printer comprising:

a support structure comprising two side walls;

a transfer apparatus slidable for advancing the substrate in an advancement direction, the transfer apparatus comprising a conveyor belt and a stationary support plane, wherein the conveyor belt comprises an outer surface configured to contact the substrate and an inner surface configured to contact the stationary support plane;

a print device arranged in proximity of the outer surface of the conveyor belt and comprising a print head operating along a print direction, perpendicular to the advancement direction;

a retaining device suitable for maintaining the substrate adherent and fixed with respect to the conveyor belt;

an adjusting device for adjusting the transfer apparatus; wherein:

the stationary support plane comprises two side ends; and the two side ends of the stationary support plane respectively rest on the two side walls of the support structure;

wherein the adjusting device comprises at least one side adjusting assembly placed between one of the two side walls and a respective one of the two side ends of the stationary support plane, wherein the at least one side adjusting assembly is configured for imposing to the side end of the stationary support plane a rotation movement around the print direction.

2. The printer according to claim 1, wherein the at least one side adjusting assembly includes two side adjusting assemblies, each of which is between one of the two side walls and the respective one of the two side ends of the stationary support plane.

3. The printer according to claim 1, wherein the at least one side adjusting assembly is suitable for imposing to the respective one of the two side ends of the stationary support plane a translation movement in an adjusting direction, perpendicular to a print plane containing the advancement direction and the print direction.

4. The printer according to claim 1, wherein the support structure further comprises a cross beam extending between the two side walls; and wherein the adjusting device of the transfer apparatus comprises a central adjusting assembly placed between the cross beam and a central portion of the stationary support plane.

5. The printer according to claim 4, wherein the central adjusting assembly is suitable for imposing to the central portion of the stationary support plane a translation movement in an adjusting direction, perpendicular to a print plane containing the advancement direction and the print direction.

6. The printer according to claim 4, wherein the retaining device comprises a vacuum system.

7. The printer according to claim 6, wherein the vacuum system comprises a vacuum box comprising an openwork wall constituting the stationary support plane.

8. The printer according to claim 7, wherein the central adjusting assembly is placed outside the vacuum box, between the cross beam and a central portion of the vacuum box.

9. The printer according to claim 1, wherein the at least one side adjusting assembly comprises at least one inclined surface fixed to the stationary support plane and inclined with respect to a print plane containing the advancement direction and the print direction, and at least one movable wedge placed between the inclined surface and the support structure.

10. The printer according to claim 9, wherein the at least one side adjusting assembly comprises a pulling screw screwed in a threaded bore of the one of the two side walls of the support structure and a pushing screw axially abutting on a surface of the one of the two side walls.

11. The printer according to claim 10, wherein the pulling screw has an axis parallel to an adjusting direction and freely moves along a smooth through bore of the respective one of the two side ends of the stationary support plane, and the pushing screw has an axis parallel to the adjusting direction and is screwed in a threaded bore of the respective one of the two side ends.

12. The printer according to claim 10, wherein the pulling screw has an axis parallel to the print direction and freely moves along a smooth through bore of the at least one movable wedge, and the pushing screw has an axis parallel to the print direction and is screwed in a threaded bore of the at least one movable wedge.

13. The printer according to claim 1, wherein the at least one side adjusting assembly comprises a front side adjusting sub-assembly and a rear side adjusting sub-assembly, spaced one from the other along the advancement direction.

14. The printer according to claim 1, wherein:

the one of the two side walls of the support structure defines an abutment;

the at least one side adjusting assembly is suitable for imposing a roto-translation movement to the abutment; and the respective one of the two side ends of the stationary support plane rests on the abutment.

15. An ink-jet printer for printing a substrate in textile, paper, polymeric or other material, the printer comprising:

a support structure comprising two side walls;

a transfer apparatus slidable for advancing the substrate in an advancement direction, the transfer apparatus comprising a conveyor belt and a stationary support plane, wherein the conveyor belt comprises an outer surface configured to contact the substrate and an inner surface configured to contact the stationary support plane;

a print device arranged in proximity of the outer surface of the conveyor belt and comprising a print head operating along a print direction, perpendicular to the advancement direction;

a retaining device suitable for maintaining the substrate adherent and fixed with respect to the conveyor belt;

an adjusting device for adjusting the transfer apparatus; wherein:

the stationary support plane comprises two side ends; and the two side ends of the stationary support plane respectively rest on the two side walls of the support structure;

wherein the adjusting device comprises at least one side adjusting assembly placed between one of the two side walls and a respective one of the two side ends of the stationary support plane, wherein the at least one side adjusting assembly comprises at least one inclined surface fixed to the stationary support plane and inclined with respect to a print plane containing the advancement direction and the print direction, and at least one movable wedge placed between the inclined surface and the support structure.

16. The printer according to claim 15, wherein the at least one side adjusting assembly comprises a pulling screw screwed in a threaded bore of the one of the two side walls of the support structure and a pushing screw axially abutting on a surface of the one of the two side walls.

17. The printer according to claim 16, wherein the pulling screw has an axis parallel to an adjusting direction and freely moves along a smooth through bore of the respective one of the respective one of the two side ends of the stationary support plane, and the pushing screw has an axis parallel to the adjusting direction and is screwed in a threaded bore of the respective one of the two side ends.

18. The printer according to claim 16, wherein the pulling screw has an axis parallel to the print direction and freely moves along a smooth through bore of the at least one movable wedge, and the pushing screw has an axis parallel to the print direction and is screwed in a threaded bore of the at least one movable wedge.

19. The printer according to claim 15, wherein the at least one side adjusting assembly comprises a front side adjusting sub-assembly and a rear side adjusting sub-assembly, spaced one from the other along the advancement direction.

20. The printer according to claim 15, wherein:

the one of the two side walls of the support structure defines an abutment;

the at least one side adjusting assembly is suitable for imposing a roto-translation movement to the abutment; and the respective one of the two side ends of the stationary support plane rests on the abutment.

* * * * *